US009971291B2

(12) United States Patent
Yaramsetti et al.

(10) Patent No.: US 9,971,291 B2
(45) Date of Patent: May 15, 2018

(54) MEDIA DESKEW USING VARIABLE BUCKLE BASED ON PRINTING CHARACTERISTIC

(71) Applicant: Xerox Corporation, Norwalk, CT (US)

(72) Inventors: Lakshmi Sujatha Yaramsetti, Hatfield (GB); Veena Kumari Saluja, Welwyn (GB); Colin William Robert Hewitt, Letchworth Garder (GB); Philip James Hambridge, Potters Bar (GB); Julius Cardozo, Goa (IN); Timothy David Jonathan Spink, Welwyn (GB)

(73) Assignee: Xerox Corporation, Norwalk, CT (US)

( * ) Notice: Subject to any disclaimer, the term of this patent is extended or adjusted under 35 U.S.C. 154(b) by 3 days.

(21) Appl. No.: 15/211,029

(22) Filed: Jul. 15, 2016

(65) Prior Publication Data

US 2018/0017921 A1 Jan. 18, 2018

(51) Int. Cl.
*G03G 15/00* (2006.01)
*G03G 21/20* (2006.01)

(52) U.S. Cl.
CPC ..... *G03G 15/5062* (2013.01); *G03G 21/203* (2013.01)

(58) Field of Classification Search
CPC . B41J 13/009; B41J 13/0095; G03G 15/5062; G03G 21/203
See application file for complete search history.

(56) References Cited

U.S. PATENT DOCUMENTS

| | | | | |
|---|---|---|---|---|
| 4,669,853 | A | 6/1987 | Sosinski et al. | |
| 4,928,141 | A | 5/1990 | Poehlein et al. | |
| 5,050,859 | A | 9/1991 | Paxon | |
| 5,166,735 | A | 11/1992 | Malachowski | |
| 5,697,608 | A * | 12/1997 | Castelli | B65H 9/002 271/228 |
| 5,775,690 | A | 7/1998 | Quesnel et al. | |
| 6,055,409 | A | 4/2000 | Richards et al. | |
| 7,006,785 | B2 | 2/2006 | Embry | |
| 7,403,737 | B2 * | 7/2008 | Coleman | G03G 15/2028 399/322 |
| 8,155,572 | B2 | 4/2012 | Richards et al. | |
| 9,108,811 | B1 | 8/2015 | Walsh et al. | |
| 2008/0197563 | A1 * | 8/2008 | Furuya | B65H 3/5261 271/265.01 |
| 2010/0226704 | A1 * | 9/2010 | Kersey | B41J 11/66 400/611 |

(Continued)

*Primary Examiner* — David Banh
(74) *Attorney, Agent, or Firm* — Gibb & Riley, LLC

(57) ABSTRACT

A media path moves media sheets from a media supply, a print engine receives the media sheets from the media path, and a sensor detects a characteristic related to the media sheets. A drive nip continuously moves the media sheets, and a stall nip receives the media sheets from the drive nip. The stall nip is positioned less than the length of one of the media sheets from the drive nip. The stall nip alternately stops or moves the media sheets while the drive nip continuously moves the media sheets, as controlled by a controller, to cause the media sheets to buckle between the drive nip and the stall nip. The controller controls when to stop or move the media sheets to constantly vary the size of the buckle, and thereby make the buckle relatively larger for a first characteristic and make the buckle relatively smaller for a different characteristic.

20 Claims, 7 Drawing Sheets

(56) References Cited

U.S. PATENT DOCUMENTS

| | | | | |
|---|---|---|---|---|
| 2011/0076035 | A1 | 3/2011 | Iwakawa | |
| 2014/0205355 | A1* | 7/2014 | Lo | B41J 13/0009 400/579 |
| 2014/0210895 | A1* | 7/2014 | Sosnowski | B41J 13/0009 347/16 |
| 2016/0116885 | A1* | 4/2016 | Pearce | G03G 15/2017 399/92 |

* cited by examiner

MEDIA DESKEW USING VARIABLE BUCKLE BASED ON PRINTING CHARACTERISTIC

BACKGROUND

Systems and methods herein generally relate to printing methods and devices, and more particularly to buckles within media being transported on media paths.

Printers feed media squarely through the device so that the image can be placed squarely on the page. Media is generally fed by using multiple drive rollers. These drive rollers can introduce skew, as the feeding roller or rollers may not be feeding at exactly the same rate (i.e., due to different feeder roller wear between the rollers or non-central applied force using a single roller, etc.). This results in an imaged printed non-squarely (skewed) on the media.

When skew occurs during feeding media through a feeding device such as a printer/copier, it can lead to an increased jam rate and a skewed imaged printed on the media.

SUMMARY

Exemplary devices, such as a printing apparatus, include (among other components) a media supply maintaining media sheets, a media path positioned to move the media sheets from the media supply, a print engine positioned to receive the media sheets from the media path, and a controller electrically connected to the media path and the print engine. The media path can have a sensor electrically connected to the controller, and the sensor detects a characteristic related to printing. The controller dynamically determines the size of a buckle that corresponds to the printing characteristic. The media path also has a drive nip (electrically connected to the controller) that continuously moves the media sheets, and a stall nip (also electrically connected to the controller) that receives the media sheets from the drive nip.

The stall nip is positioned less than the length of one of the media sheets from the drive nip. The stall nip alternately stops or moves the media sheets, while the drive nip continuously moves the media sheets (as controlled by the controller) to cause the media sheets to buckle (to the size that corresponds to the characteristic) between the drive nip and the stall nip. The controller controls when to stop and when to move the media sheets to constantly vary the size of the buckle (so that the size of the buckle always corresponds to the characteristic, which can be constantly changing) so as to make the buckle relatively larger for one characteristic, but make the buckle relatively smaller for a different characteristic (e.g., changing temperature or humidity, changing sheet weight or coating, changing wear levels of the drive rollers, etc.).

Such "characteristic" can include printing variables, such as sheet movement speed, imaging values, and finishing values; can include environmental variables, such as ambient temperature and humidity; can include media sheet factors, such as size, weight, and coating of the media sheets; etc. Additionally, the characteristic can relate to the wear levels of the drive nip that is determined by the sensor detecting the difference between the drive speed of the drive nip, and a sheet speed of the media sheets exiting the drive nip. Further, the characteristic can be the amount of skew of the media sheets that is determined by the sensor detecting the alignment of the leading edge of the media sheets, and the stall nip aligns the media sheet with the media path when the stall nip alternately stops or moves the media sheets.

Presented in a different format, methods herein maintain media sheets in a media supply, and automatically, by a media path, move the media sheets from the media supply. With such methods, a print engine automatically receives the media sheets from the media path, a sensor electrically connected to a controller automatically detects a characteristic related to printing, and the controller dynamically determines the size of a buckle that corresponds to the printing characteristic.

In these methods a drive nip electrically connected to the controller automatically continuously moves the media sheets; and a stall nip (also electrically connected to the controller) automatically receives the media sheets from the drive nip. The stall nip is positioned less than the length of one of the media sheets from said drive nip. The stall nip automatically alternately stops or moves the media sheets, while the drive nip continuously moves the media sheets, as controlled by the controller, to cause the media sheets to buckle between the drive nip and the stall nip to the size that corresponds to the printing characteristic. Further, with these methods, the controller automatically controls when to stop and when to move the media sheets to constantly vary the size of the buckle (so that the size of the buckle always corresponds to the characteristic, which can be constantly changing) and thereby make the buckle relatively larger for a first characteristic and make the buckle relatively smaller for a different characteristic.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
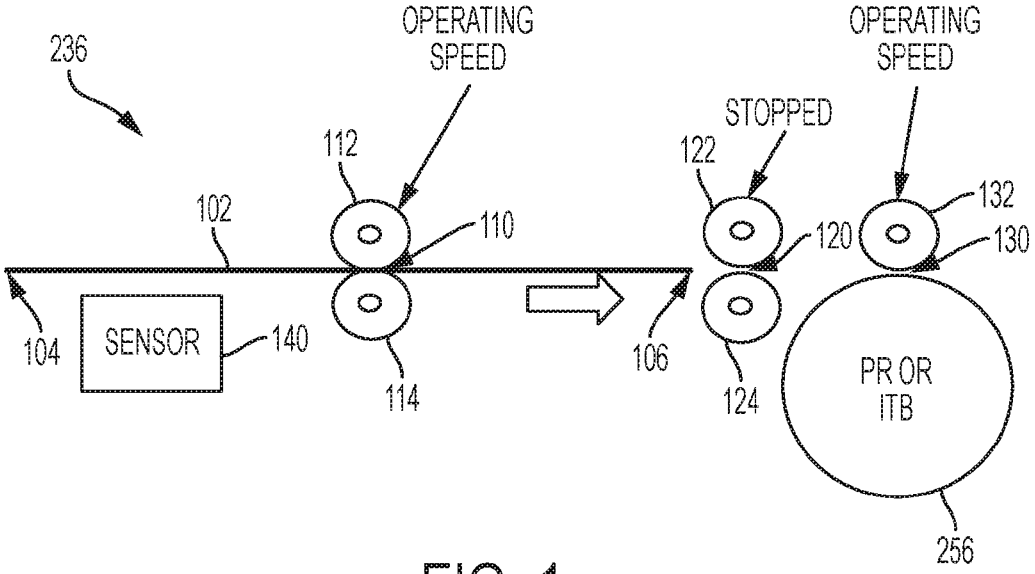
FIGS. 1-5 are schematic side-view diagrams illustrating devices herein.

As mentioned above, improper skew of print media is undesirable; however, this can be corrected by driving the media into stopped rollers for a small period of time which causes a small buckle (bend in the media) to occur which forces the lead edge of the media to align squarely in the stopped rollers. The stopped rollers are then started and the media feed through squarely again. Buckle can also be used to stop media from being dragged out of feeding rollers by other downstream rollers, when the media becomes tight in the feeding path. These processes may be repeated multiple times at various stages in the transport system.

The conventional buckle is static and does not change (or may only change based on media length) and thus only a single optimum buckle may be applied for all media types conventionally. However, label sheets, for example, do not tolerate large buckle, as the labels become detached from the backing, and long media may need a large buckle to allow the media to pass through previous rollers without being dragged through.

In view of such issues, the methods and devices herein dynamically vary the amount of applied buckle, dependent on various input factors, such as media size, length, width, transport speed, temperature, humidity, etc. This makes the applied buckle creation much more tailored, and thus more effective. The variable buckle herein is also dynamically changed to compensate for roller wear. For example, transport time can be determined by measuring the lead edge of the media arriving at a sensor (thus allowing the transport speed to be dynamically determined). The variable buckle in one example is driven by simple time line correction, which changes the buckle by a fixed amount on a chronological scale, or by monitoring changes in the media transport time. The variable buckle produced by devices and methods herein results in reduced roller wear, better skew correction, and reduced image smear.

FIGS. 1-6 illustrate portions of printing devices herein. More specifically, as illustrated in FIGS. 1-6 and 8, printing devices (apparatuses) herein can include, among other components, a printing engine 240, and a sheet path 236 feeding sheets of media 102 to the printing engine 240. The sheet path 236 can include, for example, various driven nips 110, 120, 130 (between closely spaced opposing rollers (one or more of which may be driven by a motor or actuator)). Such driven nips can include a drive nip 110 (first nip) at a first location of the sheet path 236, a stall nip 120 (second nip) at a second location of the sheet path 236, and a transfer nip 130 (third nip) at a third location of the sheet path 236.

For example, the drive nip 110 is formed between opposing rollers 112, 114 and the stall nip 120 is formed between opposing rollers 122, 124, and at least one of the rollers in each nip is powered by a motor, such as a stepper motor. The transfer nip 130 is formed between a pressure roller 132 and a transfer device 256 that contains marking material that is to be transferred to the sheet of media 102. For example, the transfer device 256 can comprise a photoreceptor (PR), an intermediate transfer belt (ITB), or any other surface that contains patterned marking material (e.g., toners, inks, etc.) that is to be transferred to the sheet of media 102. The pressure roller 132 or the transfer device 256 can similarly be powered by a motor to provide a sheet feeding speed for the transfer nip 130.

While nips 110 and 120 are referred to herein as drive and stall nips, respectively, those ordinarily skilled in the art would understand that these nips are only used as examples, and that the methods and devices herein are equally applicable to any closely spaced nips that would benefit from fed cut sheets maintaining a consistent buckle between such nips. Further, the methods and devices herein are greatly distinguished from systems that feed uncut webs of print media from rolls, because cut sheets have unique issues associated with vibrations and other physical repercussions resulting from rolls contacting the leading and trailing edges of the sheets and continuously fed webs of material do not experience such issues because they do not have leading or trailing edges. Therefore, experiences from the art of continuously fed webs of material are not germane to the art of feeding cut sheets within media paths.

The media path 236 can have one or more sensors 140 electrically connected to the controller 224, such as media type/size sensors, media thickness sensors, media flexibility sensors, media curl sensors, media coating sensors, temperature sensors, humidity sensors, media speed sensors, roller speed sensors, and/or an interface to receive inputs provided a user or provided by a print job, etc. Such sensors 140 detect one or more characteristics related to printing, such as print media type/size, thickness, flexibility, curl, and/or coating, etc.; printing conditions including printing speed, temperature, and/or humidity, etc.; print job or user input characteristics including imaging values, finishing values, ink/toner types, and/or ink/toner amounts, etc.; a mismatch between roller speed and media speed; and others. Additionally, such printing characteristics can be manually input to the printer by the user through a user interface (see GUI 212, shown in FIG. 7 and discussed below). A controller 224 (also shown in FIG. 7, discussed below) dynamically determines the size of a buckle that corresponds to the printing characteristic.

The printing devices herein also include at least one speed control circuit 224 (e.g., controller, shown in FIG. 7, discussed below) that controls the sheet feeding speeds of the drive nip 110, the stall nip 120, the transfer nip 130, etc. In operation, the drive nip 110 feeds a sheet of media 102 to the stall nip 120 along the sheet path 236. As shown in FIG. 1, the speed control circuit 224 maintains the drive nip 110 at a constant operating speed, while the stall nip 120 is slowed or stopped when the leading edge 106 of the sheet of media 102 is between the drive nip 110 and the stall nip 120 (when the sheet of media 102 is being driven only by the drive nip 110).

Figure 2:
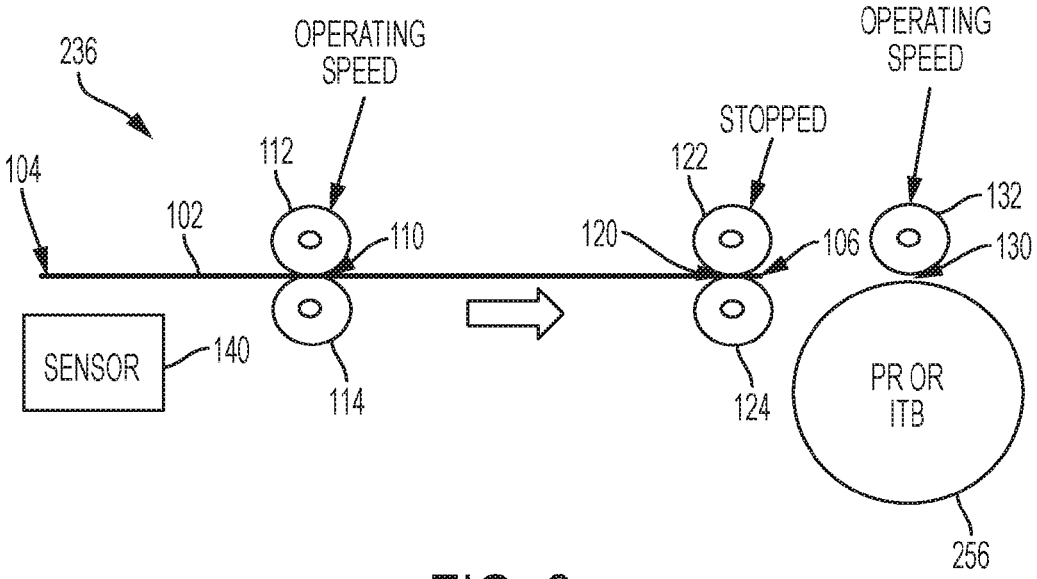

As shown in FIG. 2, the drive nip 110 is immediately adjacent (e.g., no intervening elements between the two, other than guides, etc.) the stall nip 120. For example, the distance between the drive nip 110 and the stall nip 120 is less than the lengths of the various and different sized sheets 102 the sheet path 236 is designed to accommodate, which results in the sheets of media 102 sometimes being simultaneously driven by the drive nip 110 and the stall nip 120. In FIG. 2, the drive nip 110 is rotating at the operating speed; however, the stall nip 120 is stopped or slowed relative to the drive nip 110, slowing or preventing the sheet of media 102 from proceeding through the stall nip 120, and causing the sheet of media to bend or buckle between the drive nip 110 and the stall nip 120.

Figure 3A:
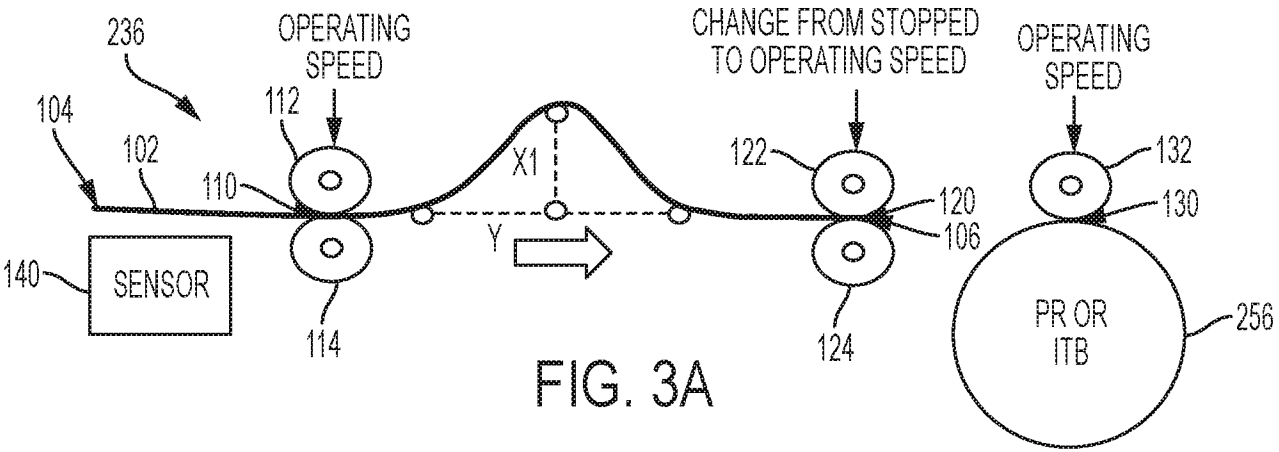
Figure 3B:
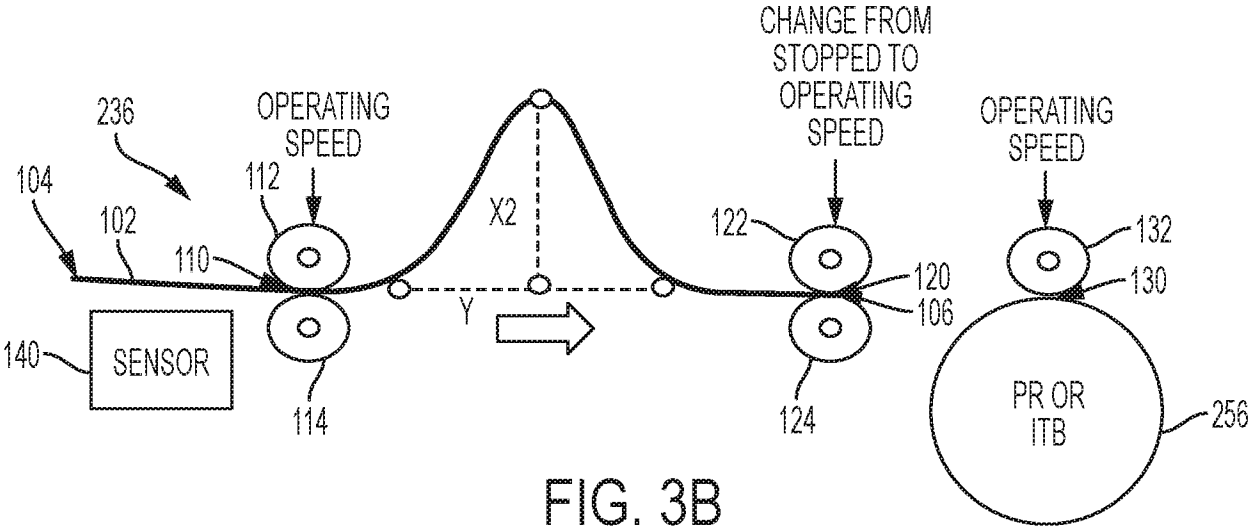

Thus, the stall nip 120 alternately stops or moves the media sheets 102 while the drive nip 110 continuously moves the media sheets 102 (as controlled by the controller 224) to cause the media sheets 102 to buckle (to the size that corresponds to the characteristic) between the drive nip and the stall nip. More specifically, as shown in FIG. 3A, as the leading edge 106 of the sheet of media 102 is stopped within the stall nip 120, the speed control circuit 224 maintains the speed of the drive nip 110 resulting in a buckle (having length Y and height X1). Once a buckle or bend having a size that corresponds to the characteristic is formed in the sheet of media 102 between the drive nip 110 and stall nip 120, the stall nip 120 then rotates at the same operating speed as the drive nip 110 to maintain the buckle at the size that corresponds to the printing characteristic. Alternatively, based on one or more characteristics detected by the sensor 140, a different sized buckle can be formed, as shown in FIG. 3B, where the buckle has length Y and height X2.

Here Y and X are intended to represent any measures of a buckle (e.g., mm, in., deg., %, etc.). Thus, the controller 224 controls when to stop and when to move the media sheets 102 to constantly vary the size of the buckle (so that the size of the buckle always corresponds to the characteristic, which can be constantly changing) so as to make the buckle relatively larger for one characteristic (e.g., FIG. 3B), but make the buckle relatively smaller for a different characteristic (e.g., FIG. 3A.). The size of the buckle is automatically and dynamically changed as the characteristic changes, such as changing temperature or humidity, changing sheet weight or coating, changing wear levels of the drive rollers, etc.

Such characteristics can include printing variables, such as sheet movement speed, imaging values, and finishing values; can include environmental variables, such as ambient temperature and humidity; can include media sheet factors, such as size, weight, and coating of the media sheets; etc. Additionally, the characteristic can relate to the wear levels of the drive nip that is determined by the sensor 140 detecting the difference between the drive speed of the drive nip 110, and a sheet speed of the media sheets 102 exiting the drive nip 110. Further, the characteristic can be the amount of skew of the media sheets 102 that is determined by the sensor 140 detecting the alignment of the leading edge 106 of the media sheets 102, and the stall nip 120 aligns the media sheet 102 with the media path 236 when the stall nip 120 alternately stops or moves the media sheets 102.

While the size of the buckle can constantly and dynamically change based on a single characteristic changing, the devices and methods herein can also combine multiple sensed characteristics together, and determine the appropriate buckle size based on a combined characteristic factor. The size of a buckle that corresponds to different combined characteristic factors is determined by empirical testing and/or modeling. In addition, the combined characteristic factors are determined using averaging, and by applying different weights to different sensor outputs.

In one example, look up tables are utilized, so that any specific value of a specific characteristic corresponds to a specific buckle size. Similarly, other look up tables produce a specific buckle size for different combined characteristic factor values. Alternatively, rather than using pre-calculated lookup tables, a combination of detected characteristics from multiple sensors can be supplied to a variety of formulas, functions, and algorithms that output a buckle size. Irrespective of the methodology utilized to produce the buckle size, the devices and methods herein constantly and dynamically change the buckle size based upon different values detected by the one or more sensors 140, as ongoing printing operations are continuously occurring.

Figure 4:
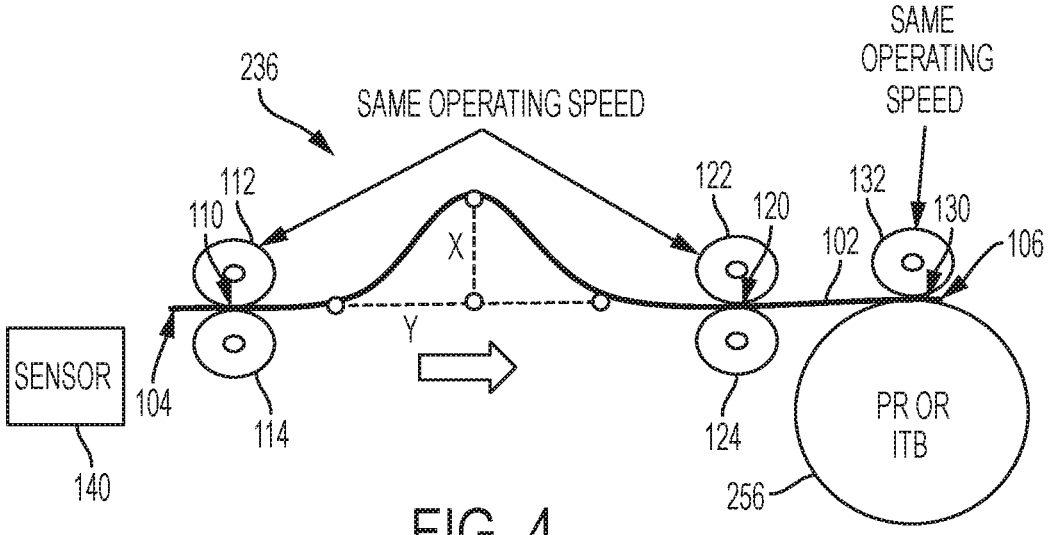
Figure 5:
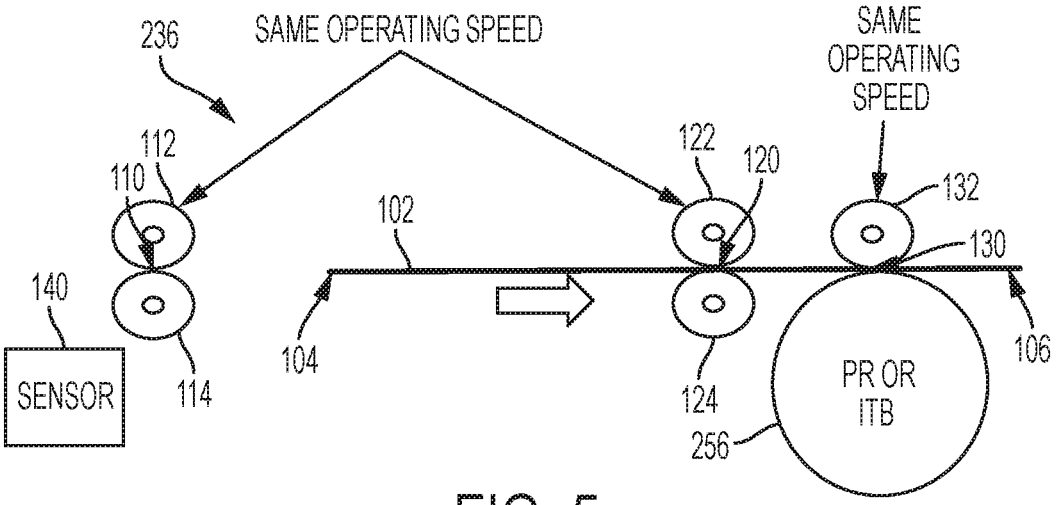

Then, after creating this desired amount of buckle in the sheet of media 102 (as shown in FIGS. 3A-3B) in FIG. 4 the speed control circuit 224 maintains the sheet feeding speed of the drive nip 110 and the stall nip 120 (and potentially the transfer nip 130) at the same operating speed during the remaining portion of when the sheet of media 102 is simultaneously within the drive nip 110 and the stall nip 120 to maintain the specific amount of buckle present in the sheet of media 102. After the trailing end 104 of the sheet 102 exits the drive nip 110 (as shown in FIG. 5) the force on the sheet 102 created by the drive nip 110 and stall nip 120 no longer exists, and the sheet once again returns to a flat state, without any buckle.

For purposes herein, a "buckle" or "bend" within a sheet occurs when at least a portion of the inboard and outboard sheet edges (that are parallel to the direction in which this sheet is being moved along the sheet path 236) become curved and are no longer completely straight or linear. Such a buckle generally occurs in the location of the sheet between from the leading edge 106 and the trailing edge 104 of the sheet.

Figure 6:
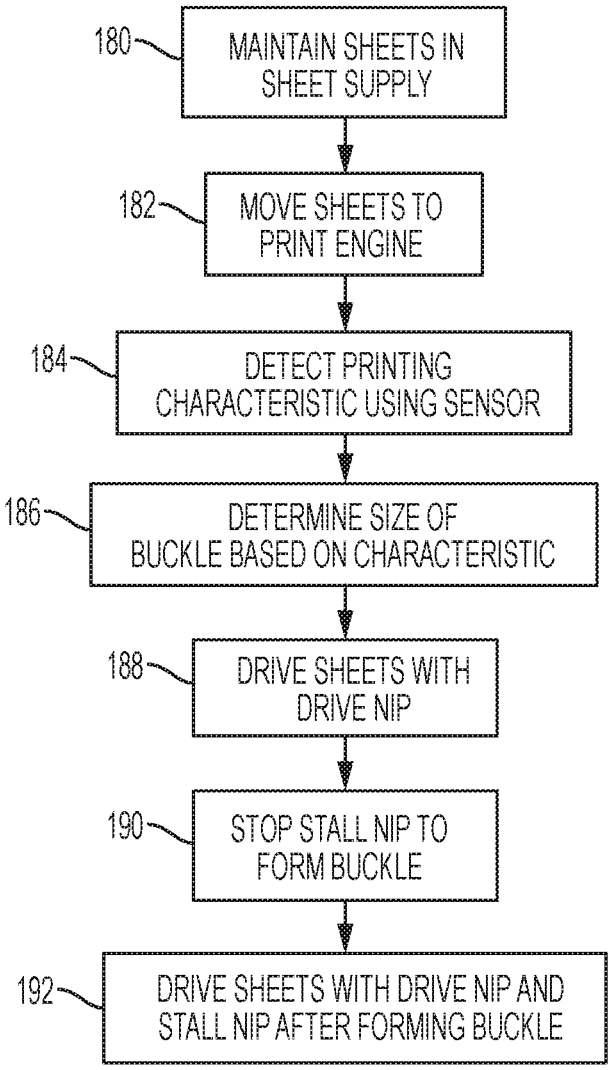
FIG. 6 is a flow diagram of various methods herein.

FIG. 6 is flowchart illustrating exemplary methods herein. As noted above, methods herein maintain media sheets in a media supply (item 180), and automatically, by a media path, move the media sheets from the media supply to a print engine automatically receives the media sheets from the media path (item 182).

One or more sensors electrically connected to a controller automatically detect one or more characteristics related to printing (item 184). For example, such characteristics can include printing variables, such as sheet movement speed, imaging values, and finishing values; can include environmental variables, such as ambient temperature and humidity; can include media sheet factors, such as size, weight, and coating of the media sheets; etc. Additionally, the characteristics can relate to the wear levels of the drive nip that is determined by the sensor detecting the difference between the drive speed of the drive nip, and a sheet speed of the media sheets exiting the drive nip. Further, the characteristic can be the amount of skew of the media sheets that is determined by the sensor detecting the alignment of the leading edge of the media sheets, and the stall nip aligns the media sheet with the media path when the stall nip alternately stops or moves the media sheets.

In item 186, these methods determine the amount of buckle that will be formed (dynamically and continuously) as sheets are being feed along the media path based on one or more characteristics detected by the sensors in item 184. Any of the characteristics can dictate an increase or decrease in buckle size (based on empirical testing and modeling with different print media types, weights, and lengths).

In these methods, a drive nip electrically connected to the controller automatically continuously moves the media sheets (item 188); and a stall nip (also electrically connected to the controller) automatically receives the media sheets from the drive nip. The stall nip is positioned less than the length of one of the media sheets from said drive nip. The stall nip automatically alternately stops or moves the media sheets. Thus, in item 190, these methods stop the media sheets in the stall nip while the drive nip continuously moves the media sheets, as controlled by the controller, to cause the media sheets to buckle between the drive nip and the stall nip to the size that corresponds to the printing characteristic.

Further, in item 192, after the buckle is formed, the sheets are driven with both the drive nip and the stall nip (which operate at the same speed to maintain the buckle). The controller automatically controls when to stop and when to move the media sheets through the stall nip to constantly vary the size of the buckle (so that the size of the buckle always corresponds to the characteristic, which can be constantly changing) and thereby make the buckle relatively larger for a first characteristic and make the buckle relatively smaller for a different characteristics. Therefore, item 192 only operates the stall nip at the same operating speed of the drive nip after the appropriately sized buckle has been established.

Figure 7:
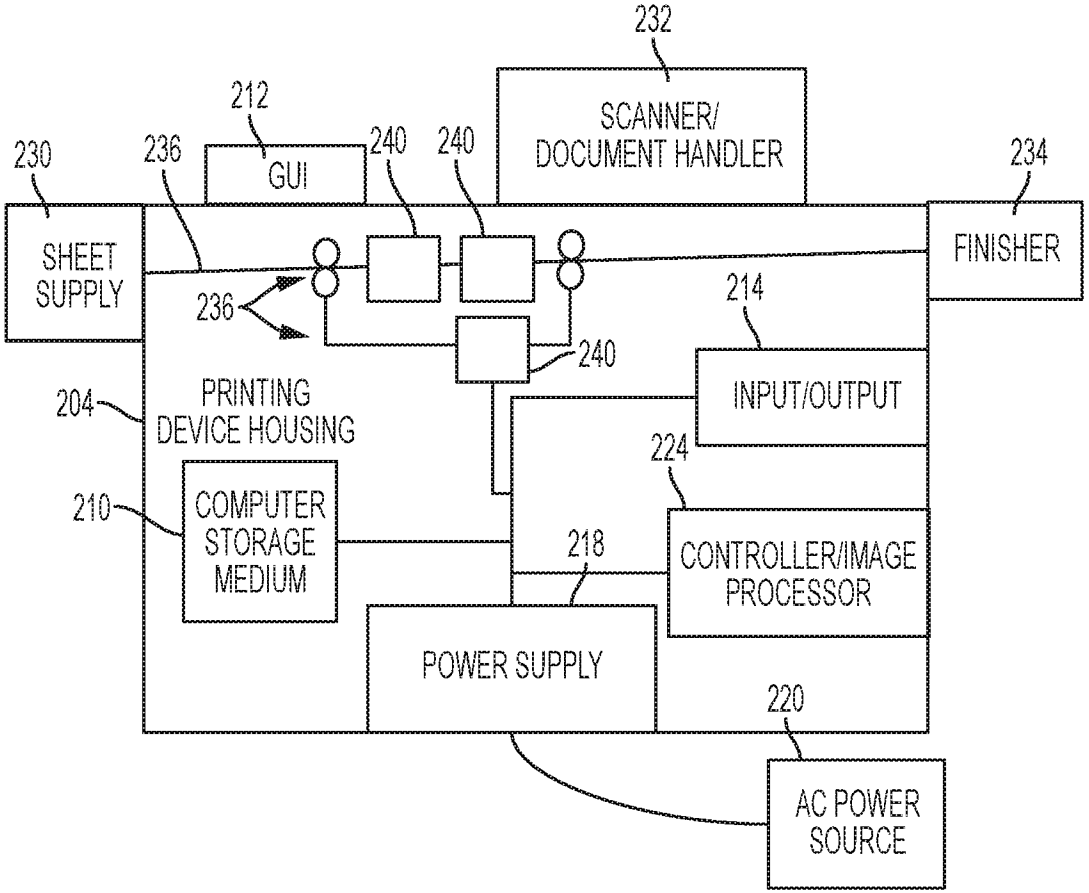
FIG. 7 is a schematic side-view diagram illustrating a printing device herein.

FIG. 7 illustrates a computerized device that is a printing device 204, which can be used with devices and methods herein and can comprise, for example, a printer, copier, multi-function machine, multi-function device (MFD), etc. The printing device 204 includes a communications port (input/output) 214 operatively connected to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). A specialized image processor 224 (that is different from a general purpose computer because it is specialized for processing image data and controlling internal components of a printing device, such as the speed of nips, etc.) controls the various actions of the computerized device. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 7, a body housing has one or more functional components that operate on power supplied from an alternating current (AC) source 220 by the power supply 218. The power supply 218 can comprise a common power conversion unit, power storage element (e.g., a battery, etc), etc.

The printing device 204 includes at least one marking device (printing engine(s)) 240 operatively connected to the specialized image processor 224, a media path 236 positioned to supply sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

Figure 8:
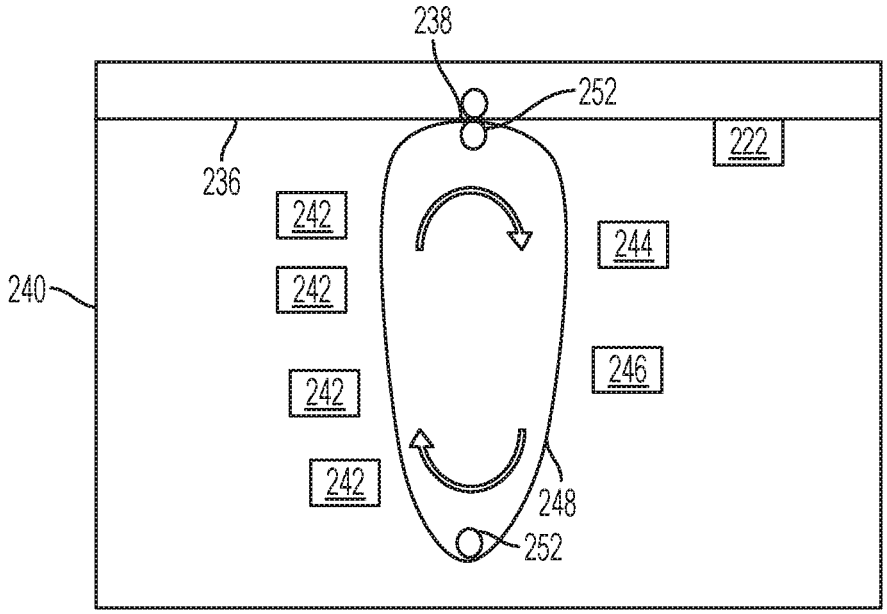
FIGS. 8-10 are schematic side-view diagrams illustrating aspects of printing devices herein.
Figure 10:
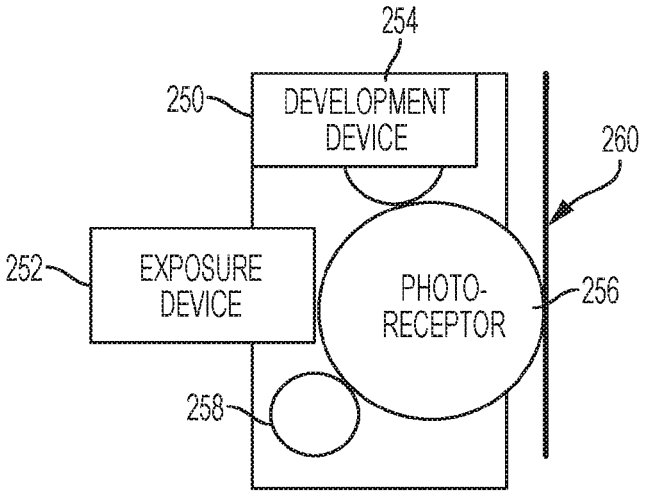

The one or more printing engines 240 are intended to illustrate any marking device that applies a marking material (toner, inks, etc.) to sheets of media, whether currently known or developed in the future and can include, for example, devices that use a photoreceptor belt 248 (as shown in FIG. 8) or an intermediate transfer belt 258 (as shown in FIG. 10), or devices that print directly to print media (e.g., inkjet printers, ribbon-based contact printers, etc.).

More specifically, FIG. 8 illustrates one example of the above-mentioned printing engine(s) 240 that uses one or more (potentially different color) development stations 242 adjacent a photoreceptor belt 248 supported on rollers 252. In FIG. 8 an electronic or optical image or an image of an original document or set of documents to be reproduced may be projected or scanned onto a charged surface of the photoreceptor belt 248 using an imaging device (sometimes called a raster output scanner (ROS)) 246 to form an electrostatic latent image. Thus, the electrostatic image can be formed onto the photoreceptor belt 248 using a blanket charging station/device 244 (and item 244 can include a cleaning station or a separate cleaning station can be used) and the imaging station/device 246 (such as an optical projection device, e.g., raster output scanner). Thus, the imaging station/device 246 changes a uniform charge created on the photoreceptor belt 248 by the blanket charging station/device 244 to a patterned charge through light exposure, for example.

The photoreceptor belt 248 is driven (using, for example, driven rollers 252) to move the photoreceptor in the direction indicated by the arrows past the development stations 242, and a transfer station 238. Note that devices herein can include a single development station 242, or can include multiple development stations 242, each of which provides marking material (e.g., charged toner) that is attracted by the patterned charge on the photoreceptor belt 248. The same location on the photoreceptor belt 248 is rotated past the imaging station 246 multiple times to allow different charge patterns to be presented to different development stations 242, and thereby successively apply different patterns of different colors to the same location on the photoreceptor belt 248 to form a multi-color image of marking material (e.g., toner) which is then transferred to print media at the transfer station 238.

As is understood by those ordinarily skilled in the art, the transfer station 238 generally includes rollers and other transfer devices. Further, item 222 represents a fuser device that is generally known by those ordinarily skilled in the art to include heating devices and/or rollers that fuse or dry the marking material to permanently bond the marking material to the print media.

Thus, in the example shown in FIG. 8, which contains four different color development stations 242, the photoreceptor belt 248 is rotated through four revolutions in order to allow each of the development stations 242 to transfer a different color marking material (where each of the development stations 242 transfers marking material to the photoreceptor belt 248 during a different revolution). After all such revolutions, four different colors have been transferred to the same location of the photoreceptor belt, thereby forming a complete multi-color image on the photoreceptor belt, after which the complete multi-color image is transferred to print media, traveling along the media path 236, at the transfer station 238.

Figure 9:
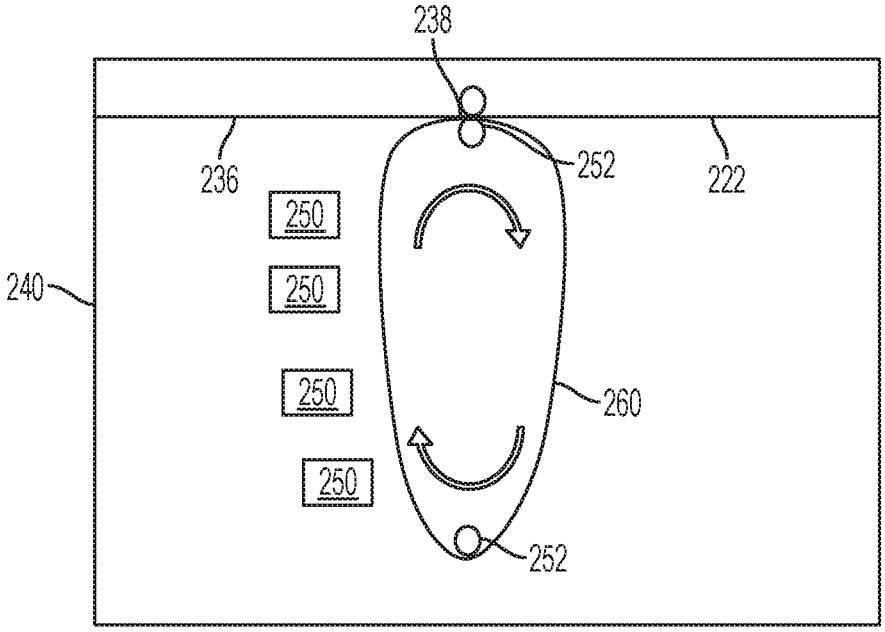

Alternatively, printing engine(s) 240 shown in FIG. 7 can utilize one or more potentially different color marking stations 250 and an intermediate transfer belt (ITB) 260 supported on rollers 252, as shown in FIG. 9. The marking stations 250 can be any form of marking station, whether currently known or developed in the future, such as individual electrostatic marking stations, individual inkjet stations, individual dry ink stations, etc. Each of the marking stations 250 transfers a pattern of marking material to the same location of the intermediate transfer belt 260 in sequence during a single belt rotation (potentially independently of a condition of the intermediate transfer belt 260) thereby, reducing the number of passes the intermediate transfer belt 260 must make before a full and complete image is transferred to the intermediate transfer belt 260.

One exemplary individual electrostatic marking station 250 is shown in FIG. 10 positioned adjacent to (or potentially in contact with) intermediate transfer belt 260. Each of the individual electrostatic marking stations 250 includes its own charging station 258 that creates a uniform charge on an internal photoreceptor 256, an internal exposure device 252 that patterns the uniform charge, and an internal development device 254 that transfers marking material to the photoreceptor 256. The pattern of marking material is then transferred from the photoreceptor 256 to the intermediate transfer belt 260 and eventually from the intermediate transfer belt to the marking material at the transfer station 238.

While FIGS. 8 and 9 illustrate four marking stations 242, 250 adjacent or in contact with a rotating belt (248, 260), which is useful with systems that mark in four different colors such as, red, green, blue (RGB), and black; or cyan, magenta, yellow, and black (CMYK), as would be understood by those ordinarily skilled in the art, such devices could use a single marking station (e.g., black) or could use any number of marking stations (e.g., 2, 3, 5, 8, 11, etc.).

Thus, in printing devices herein a latent image can be developed with developing material to form a toner image corresponding to the latent image. Then, a sheet is fed from a selected paper tray supply to a sheet transport for travel to a transfer station. There, the image is transferred to a print media material, to which it may be permanently fixed by a fusing device. The print media is then transported by the sheet output transport 236 to output trays or a multi-function finishing station 234 performing different desired actions, such as stapling, hole-punching and C or Z-folding, a modular booklet maker, etc., although those ordinarily skilled in the art would understand that the finisher/output tray 234 could comprise any functional unit.

As would be understood by those ordinarily skilled in the art, the printing device 204 shown in FIG. 7 is only one example and the devices and methods herein are equally applicable to other types of printing devices that may include fewer components or more components. For example, while a limited number of printing engines and media paths are illustrated in FIG. 7, those ordinarily skilled in the art would understand that many more media paths and additional printing engines could be included within any printing device used with devices and methods herein.

While some exemplary structures are illustrated in the attached drawings, where like numbers identify the same or similar items, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the devices and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The devices and methods herein can encompass devices and methods that print in color, monochrome, or handle color or monochrome image data. All foregoing devices and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices and methods herein cannot be implied or imported from any above example as limitations to any particular order, number, position, size, shape, angle, color, or material.

What is claimed is:

1. An apparatus comprising:

a media supply maintaining media sheets;

a media path positioned to move said media sheets from said media supply;

a processing element positioned to receive said media sheets from said media path, and a controller electrically connected to said media path, said media path comprising:

at least one sensor detecting one or more characteristics related to printing;

a drive nip continuously moving said media sheets; and a stall nip receiving said media sheets from said drive nip, said stall nip is positioned less than the length of one of said media sheets from said drive nip, said stall nip alternately stops or moves said media sheets while said drive nip continuously moves said media sheets as controlled by said controller to cause said media sheets to buckle between said drive nip and said stall nip, said stall nip controls when to stop and when to move said media sheets as controlled by said controller to constantly vary the size of said buckle based on said one or more characteristics detected by said at least one sensor, and said one or more characteristics comprise at least one of wear levels of said drive nip and the amount of skew of said media sheets.

2. The apparatus according to claim 1, said stall nip controls when to stop and when to move said media sheets to constantly vary the size of said buckle as controlled by said controller to make said buckle relatively larger or make said buckle relatively smaller for different ones of said one or more characteristics.

3. The apparatus according to claim 1, said one or more characteristics further comprise printing variables including at least one of sheet movement speed, imaging values, and finishing values.

4. The apparatus according to claim 1, said one or more characteristics further comprise at least one of ambient temperature and humidity.

5. The apparatus according to claim 1, said wear levels of said drive nip are determined by said at least one sensor detecting a difference between the drive speed of said drive nip and a sheet speed of said media sheets exiting said drive nip.

6. The apparatus according to claim 1, said amount of skew of said media sheets is determined by said at least one sensor detecting the alignment of the leading edge of said media sheets, and said stall nip aligns said media sheet with said media path when said stall nip alternately stops or moves said media sheets.

7. The apparatus according to claim 1, said one or more characteristics comprise at least one of size, weight, and coating of said media sheets.

8. A printing apparatus comprising:

a media supply maintaining media sheets;

a media path positioned to move said media sheets from said media supply;

a print engine positioned to receive said media sheets from said media path; and a controller electrically connected to said media path and said print engine, said media path comprising:

at least one sensor electrically connected to said controller, said at least one sensor detects one or more characteristics related to printing;

a drive nip electrically connected to said controller, said drive nip continuously moves said media sheets; and a stall nip electrically connected to said controller, said stall nip receives said media sheets from said drive nip, said controller dynamically determines a size of a buckle that corresponds to said one or more characteristics, said stall nip is positioned less than the length of one of said media sheets from said drive nip, said stall nip alternately stops or moves said media sheets while said drive nip continuously moves said media sheets as controlled by said controller to cause said media sheets to buckle to said size between said drive nip and said stall nip, said controller controls when to stop and when to move said media sheets to constantly vary the size of said buckle based on said one or more characteristics detected by said at least one sensor, and said one or more characteristics comprise at least one of wear levels of said drive nip and the amount of skew of said media sheets.

9. The printing apparatus according to claim 8, said controller controls when to stop and when to move said media sheets to constantly vary said size of said buckle to make said buckle relatively larger or make said buckle relatively smaller for different ones of said one or more characteristics.

10. The printing apparatus according to claim 8, said one or more characteristics further comprise printing variables including at least one of sheet movement speed, imaging values, and finishing values.

11. The printing apparatus according to claim 8, said one or more characteristics further comprise at least one of ambient temperature and humidity.

12. The printing apparatus according to claim 8, wear levels of said drive nip are determined by said at least one sensor detecting a difference between the drive speed of said drive nip and a sheet speed of said media sheets exiting said drive nip.

13. The printing apparatus according to claim 8, said amount of skew of said media sheets is determined by said at least one sensor detecting the alignment of the leading edge of said media sheets, and said stall nip aligns said media sheet with said media path when said stall nip alternately stops or moves said media sheets.

14. The printing apparatus according to claim 8, said one or more characteristics comprise at least one of size, weight, and coating of said media sheets.

15. A method comprising:

automatically, by at least one sensor electrically connected to a controller, detecting one or more characteristics of a printing apparatus related to printing;

automatically, by said controller of said printing apparatus, dynamically determining a size of a buckle that corresponds to said one or more characteristics;

automatically, by a drive nip of said printing apparatus electrically connected to said controller, continuously moving media sheets from a media supply to a print engine of said printing apparatus;

automatically, by a stall nip of said printing apparatus electrically connected to said controller, receiving said media sheets from said drive nip, said stall nip is positioned less than the length of one of said media sheets from said drive nip;

automatically, by said stall nip as controlled by said controller, alternately stopping and moving said media sheets while said drive nip continuously moves said media sheets to cause said media sheets to buckle to said size between said drive nip and said stall nip; and automatically, by said controller, controlling when to stop and when to move said media sheets to constantly vary the size of said buckle based on said one or more characteristics detected by said at least one sensor, said one or more characteristics comprise at least one of wear levels of said drive nip and the amount of skew of said media sheets.

16. The method according to claim 15, said controlling when to stop and when to move said media sheets to constantly vary said size of said buckle makes said buckle relatively larger or makes said buckle relatively smaller for different ones of said one or more characteristics.

17. The method according to claim 15, said one or more characteristics further comprise printing variables including at least one of sheet movement speed, imaging values, and finishing values.

18. The method according to claim 15, said one or more characteristics further comprise at least one of ambient temperature and humidity, and size, weight, and coating of said media sheets.

19. The method according to claim 15, said wear levels of said drive nip are determined by said at least one sensor detecting a difference between the drive speed of said drive nip and a sheet speed of said media sheets exiting said drive nip.

20. The method according to claim 15, said amount of skew of said media sheets is determined by said at least one sensor detecting the alignment of the leading edge of said media sheets, and said stall nip aligns said media sheet with said media path when said stall nip alternately stops or moves said media sheets.

* * * * *